US011800922B2

(12) United States Patent
Bae

(10) Patent No.: US 11,800,922 B2
(45) Date of Patent: Oct. 31, 2023

(54) HAIR PACK

(71) Applicant: Ilhyung Bae, Seoul (KR)

(72) Inventor: Ilhyung Bae, Seoul (KR)

( * ) Notice: Subject to any disclaimer, the term of this patent is extended or adjusted under 35 U.S.C. 154(b) by 335 days.

(21) Appl. No.: 16/588,150

(22) Filed: Sep. 30, 2019

(65) Prior Publication Data

US 2020/0113312 A1 Apr. 16, 2020

Related U.S. Application Data

(63) Continuation-in-part of application No. PCT/KR2018/003365, filed on Mar. 22, 2018.

(30) Foreign Application Priority Data

Mar. 31, 2017 (KR) ..... 10-2017-0041930

(51) Int. Cl.
*A45D 44/00* (2006.01)
*A45D 29/00* (2006.01)

(52) U.S. Cl.
CPC ..... *A45D 44/00* (2013.01); *A45D 29/00* (2013.01); *A45D 2200/1036* (2013.01)

(58) Field of Classification Search
CPC ..... A45D 8/40; A45D 19/00; A45D 19/005; A45D 19/18; A45D 19/14; A45D 19/16; A45D 44/08; A45D 44/12; A41B 13/10; A41B 11/00; A41D 3/08; A41D 13/1169; A41D 20/00; A41D 13/11; A41D 13/0058; A41D 13/00543; A41D 13/0587; A41D 13/0593; A41D 13/012; A41D 13/06; A41D 20/005; A41D 20/1169; A41D 27/16; A42B 1/012; A42B 1/017; A42B 1/12; A42B 1/041; A42B 1/04; A42B 1/18; A42B 1/201; A42B 1/205; A42B 1/225; A42B 1/241; A61F 13/08
USPC ..... 2/174, 209.14, 239
See application file for complete search history.

(56) References Cited

U.S. PATENT DOCUMENTS 2,424,129 A * 7/1947 Vincelle ..... A61H 7/006 601/136
2,858,834 A * 11/1958 Givens ..... A45D 19/18 132/212
3,088,469 A * 5/1963 Berryhill ..... A61K 8/0208 132/212

(Continued)

FOREIGN PATENT DOCUMENTS

CN 105636476 B 9/2018
JP S55-109648 A 8/1980

(Continued)

OTHER PUBLICATIONS

International Search Report issued in PCT/KR2018/003365; dated Jul. 2, 2018.

*Primary Examiner* — Cris L. Rodriguez
*Assistant Examiner* — Karim Asqiriba
(74) *Attorney, Agent, or Firm* — Studebaker & Brackett PC

(57) ABSTRACT

The present disclosure relates to a wearable pack. A wearable pack according to the present disclosure includes a first sheet formed in an elliptical shape, and a second sheet coupled to the first sheet, the second sheet being formed in a shape corresponding to the first sheet and including an opening that is sealable. An inner space is formed between the first sheet and the second sheet to accommodate a pack agent therein.

12 Claims, 16 Drawing Sheets

(56) References Cited

U.S. PATENT DOCUMENTS

| | | | | | |
|---|---|---|---|---|---|
| 4,289,150 | A * | 9/1981 | Kimball | A45D 19/18 | 132/208 |
| 5,265,278 | A * | 11/1993 | Watanabe | A45D 2/46 | 2/174 |
| 5,778,455 | A * | 7/1998 | Joseph | A45D 44/12 | 2/174 |
| 6,047,706 | A * | 4/2000 | Skiba | A45D 19/00 | 132/200 |
| 6,351,852 | B1 * | 3/2002 | Propp | A45D 19/14 | 132/200 |
| 6,622,310 | B1 * | 9/2003 | Tsai | A42B 1/041 | 2/202 |
| 2004/0040066 | A1 * | 3/2004 | Hardenbrook | A45D 19/18 | 2/171 |
| 2011/0173739 | A1 * | 7/2011 | Riesen | A42B 1/225 | 2/209.3 |
| 2012/0079643 | A1 | 4/2012 | Clarke | | |
| 2013/0026748 | A1 * | 1/2013 | Liu | G09F 3/0292 | 428/40.1 |
| 2015/0196108 | A1 * | 7/2015 | Jung | A45D 19/18 | 132/220 |
| 2019/0090561 | A1 * | 3/2019 | Brandt | A41D 23/00 | |

FOREIGN PATENT DOCUMENTS

| | | | |
|---|---|---|---|
| JP | 2016-077858 | A | 5/2016 |
| KR | 20-2011-0003186 | A | 1/2011 |
| KR | 10-1407538 | B1 | 6/2014 |
| KR | 10-1427178 | B1 | 8/2014 |
| KR | 10-1813449 | B1 | 12/2017 |

* cited by examiner

HAIR PACK

CROSS-REFERENCE TO RELATED APPLICATIONS

This application is a Continuation-in-Part of International Application No. PCT/KR2018/003365 filed Mar. 22, 2018, which claims benefit of priority to Korean Patent Application No. 10-2017-0041930 filed Mar. 31, 2017, the entire content of which is incorporated herein by reference.

TECHNICAL FIELD

The present invention relates to a wearable pack, and more particularly, to a wearable pack for taking care of a portion of human body such as hair, scalp, foot, etc.

BACKGROUND

Recently, interest in beauty of hair or skin is increasing regardless of age or gender. However, frequent dyeing and perming and the use of waxes or hairsprays causes significant damage to hair. Such damage is further aggravated due to air pollution or water pollution as well as various stresses. Also, while feet are considered as an important part of a human body as being so called a second heart of a human body, they are vulnerable to fatigue or stress because they support the body all day long. In particular, when putting fashionable shoes or high heels on feet, it causes more stress to the feet or toes and often leads to skin hardening or discoloration of the feet.

Accordingly, hair pack or foot pack products have been developed for protecting hair or feet or treating damaged areas in the hair, scalp or feet. However, conventional hair packs or foot packs are inconvenient in that the user has to manually apply the pack agent to the head or feet.

Accordingly, a hair pack or foot pack in which a pack agent is pre-accommodated in a typical shower cap or socks form has been proposed. For example, in such a hair pack, a sheet covering a left portion of the user's head and a sheet covering a right portion of the user's head are overlapped, the sheets are sealed along the circumference of the sheets except for one side thereof, and the pack agent is accommodated therein. Accordingly, the user uses the hair pack by opening the unsealed side and putting his or her head therein as if wearing a cap.

However, a user with long hair may feel inconvenient in using the hair pack because the user has to wear the hair pack after piling the hair on top of his or her head. Further, there is a problem in that the treatment effect of the hair pack may be deteriorated because the pack agent cannot be properly applied on the piled hair.

Also, when an opening of the hair pack does not fit the user's head circumference, a fastening strap or a tape is used to fix the hair pack to fit the user's hair circumference. However, the fixing means may be separated from the hair pack and not properly fixed, or, even when the fixing means is fixed, the hair pack made of synthetic resin or the like may not be closely adhered along the head circumference. In such cases, the pack agent may spill through a gap between the hair pack and the head.

Also, in the hair pack, the sealing line passes from the forehead to the back part of the head through the top part of the head. When the user opens the unsealed side as described above in order to wear the hair pack, the sealing line may be torn due to a relatively large force being applied to both ends of the sealing line or a portion thereof at the top part of the head.

Furthermore, since the pack agent may leak to the outside through the open one side, there is a limitation that the pack agent should be accommodated only in a specific space.

SUMMARY

The present invention is directed to providing a wearable pack which is easy to use even by users with long hair.

The present invention is also directed to providing a wearable pack which allows a pack agent to be uniformly applied to the entire hair.

The present invention is also directed to providing a wearable pack which is prevented from being slipped off from a hair or feet during use even without a separate fixing means.

The present invention is also directed to providing a wearable pack which is capable of preventing the pack agent from spilling during use even without a separate fixing means.

The present invention is also directed to providing a wearable pack which is capable of preventing a sealing line from being unintentionally torn or ripped when wearing the hair pack.

The present invention is also directed to providing a wearable pack which is capable of preventing the pack agent from leaking to the outside or being denatured during storage.

The present invention is also directed to providing a wearable pack which is capable of adhering closely to a hair during use.

According to one embodiment of the present invention, a wearable pack comprises: a first sheet formed in an elliptical shape; and a second sheet coupled to the first sheet, the second sheet being formed in a shape corresponding to the first sheet and including an opening that is sealable, wherein an inner space is formed between the first sheet and the second sheet to accommodate a pack agent therein.

According to one embodiment, the first sheet includes a first end portion and a second end portion that is wider than the first end portion, and wherein the opening is arranged in the second sheet closer to the first end portion than the second end portion.

According to one embodiment, at least a partial region including a surrounding portion of the opening in the second sheet is made of an elastic material.

According to one embodiment, the opening in the second sheet is formed in a slit shape extending in a long axis direction of the elliptical shape.

According to one embodiment, the wearable pack further comprises a sticker detachably attached to the second sheet to block the opening.

According to one embodiment, the opening includes an inner area of the second sheet, the inner area being enclosed by a discontinuous cutting line formed along a circumference of the opening, and when the sticker is detached from the second sheet, the inner area is removed from the second sheet together with the sticker.

According to one embodiment, least one of the first sheet and the second sheet is made of elastic material.

According to one embodiment, the opening in the second sheet is formed in a shape extending in a short axis direction of the elliptical shape.

According to one embodiment, a circumference of the first sheet is sealed to a circumference of the second sheet by using at least one of sewing, heat sealing or an adhesive.

According to one embodiment, the pack agent is accommodated in the inner space in the state of being applied to or absorbed into a surface of at least one of the first sheet or the second sheet.

According to one embodiment, the first sheet and the second sheet are treated to be waterproof.

According to another embodiment of the present invention, a wearable pack comprises: a first sheet formed in an oval shape; and a second sheet coupled to the first sheet, the second sheet being formed in a shape corresponding to the first sheet and including an opening that is sealable, wherein an inner space is formed between the first sheet and the second sheet to accommodate a pack agent therein.

According to one embodiment, at least a partial region including a surrounding portion of the opening in the second sheet is made of an elastic material.

According to one embodiment, the opening in the second sheet is formed in a slit shape extending in a long axis direction of the elliptical shape.

According to one embodiment, the wearable pack further comprises a sticker detachably attached to the second sheet to block the opening.

According to one embodiment, the opening includes an inner area of the second sheet, the inner area being enclosed by a discontinuous cutting line formed along a circumference of the opening, and when the sticker is detached from the second sheet, the inner area is removed from the second sheet together with the sticker.

According to one embodiment, least one of the first sheet and the second sheet is made of elastic material.

According to one embodiment, the opening in the second sheet is formed in a shape extending in a short axis direction of the elliptical shape.

According to one embodiment, a circumference of the first sheet is sealed to a circumference of the second sheet by using at least one of sewing, heat sealing or an adhesive.

According to one embodiment, the pack agent is accommodated in the inner space in the state of being applied to or absorbed into a surface of at least one of the first sheet or the second sheet.

According to one embodiment, the first sheet and the second sheet are treated to be waterproof.

In a wearable pack according to various embodiments of the present invention, when being put on a user's head, a relatively larger space is provided in a portion corresponding to a back part of the head. Therefore, a user with long hair can easily use the hair pack while keeping the entire hair loose in the back part of the head. Also, in this way, a pack agent can be more evenly applied to the scalp and hair.

Also, since an area including a surrounding portion of an opening is formed of an elastic material, and the opening is formed smaller than a head circumference of the user, the surrounding portion of the opening is adhered to the user's hair. Therefore, the pack agent can be prevented from spilling through a gap between the surrounding portion of the opening and the user's head. Also, in this way, the hair pack is more convenient to use because there is no need for a separate fixing means such as a fastening strap or a tape.

Also, a lower sheet and an upper sheet which mostly covers the top part of the user's head are overlapped and sealed along the circumference thereof, and thus, a sealing line is formed along a portion surrounding the top part of the user's head. In this way, a sealing line can be prevented from being unintentionally torn or ripped when wearing the wearable pack.

Also, a sticker is attached to block the opening, and thus, the pack agent can be prevented from leaking to the outside or being dried or denatured during storage. Particularly, since a discontinuous cutting line is formed around an area where the opening is to be formed, and the sticker is attached to cover the area, when the sticker is removed, the area is removed together with the sticker, and the opening is formed. In this way, the pack agent can be further prevented from being denatured due to coming in direct contact with the sticker.

Also, since at least a portion of the wearable pack is made of a heat shrinkable materials, a user may make the wearable pack closely adhere to his/her head's shape, for example, by blowing a warm or hot air to the wearable pack using a hair dryer.

When a wearable pack according to various embodiments of the present is put on a foot, a lower sheet, which mostly covers a bottom of the foot, and an upper sheet, which includes an opening formed thereon and mostly covers a top side of the foot, are overlapped and sealed along the circumference thereof. In this way, a sealing line can be prevented from being unintentionally torn or ripped when wearing the wearable pack. Further, since the sealing line is located upper in the wearable pack than the ground, the pack agent can be further prevented from being leaked from the pack and being contact with the ground even when the sealing line is torn.

Further, a portion of the wearable pack including a circumference of the opening is made of elastic material and the circumference of the opening has a smaller size than an average user's ankle surrounding when an external force is urged again the opening. In this way, the circumference of the opening closely adheres to the user's ankle, which prevents the wearable pack from being slipped off from the foot. This eliminates needs for adding any fixing means to the wearable pack such as a separate tightening strip or tape and thus makes the configuration of the wearable pack simple and convenient for use.

BRIEF DESCRIPTION OF THE DRAWINGS

Embodiments of the present invention will be described, by way of example only, and with reference to the following drawings.

DETAILED DESCRIPTION

Figure 1:
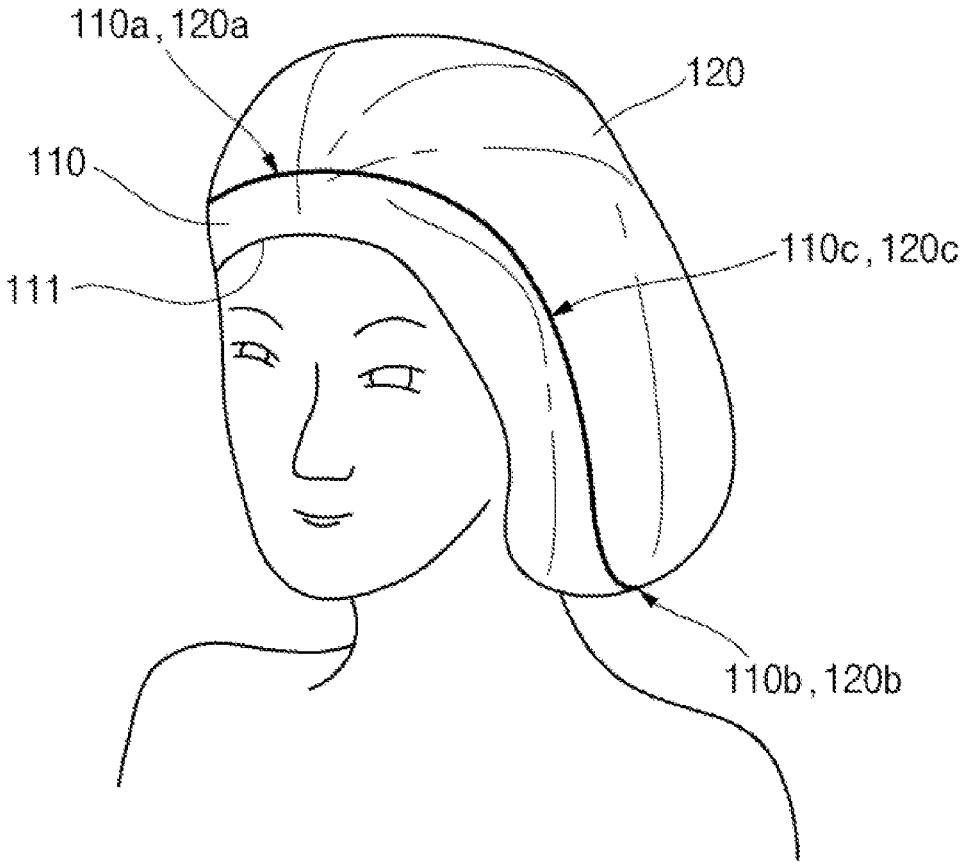
FIG. 1 is a perspective view illustrating a state in which a user is wearing a hair pack according to an embodiment of the present invention.

Some preferable embodiments will be described in more detail with reference to the accompanying drawings, in which the preferable embodiments of the present disclosure have been illustrated. However, the present disclosure can be implemented in various manners, and thus should not be construed to be limited to the embodiments disclosed herein. On the contrary, those embodiments are provided for the thorough and complete understanding of the present disclosure, and completely conveying the scope of the present disclosure to those skilled in the art.

It should be noted that in the drawings, like components or parts may be represented by like reference numerals, if possible. In describing the present disclosure, when a detailed description about a related well-known art may obscure the gist of the present disclosure, the detailed description thereof will not be provided.

In the accompanying drawings, like or relevant components may be indicated by like reference numerals. In the following description of the embodiments, repeated descriptions of the identical or relevant components may be omitted. However, even if a description of a component is omitted, such a component is not intended to be excluded in an embodiment. The relative terms such as the terms "upper portion" and "upper side" may be used to describe a relationship between components shown in the drawings, and the present disclosure is not limited to the terms.

In the present disclosure, a "wearable pack" may refer to a product manufactured in a form of a pack configured to accommodate a pack agent for protecting a portion of a human body such as a hair or foot or treating a damaged portion thereof. For example, a wearable pack includes various forms of pack product for protecting a portion of a human body or providing nutrition for a damaged portion thereof, which includes, but not limiting to, a hair pack or a foot pack configured to protect a hair, a scalp or a foot or provide nutrition therefor.

FIG. 1 is a perspective view illustrating a state in which a user is wearing a hair pack 100 according to an embodiment of the present invention. Also, FIG. 2 is a bottom view of the hair pack 100 according to the embodiment of the present invention, FIG. 3 is a plan view of the hair pack 100 according to the embodiment of the present invention, and FIG. 4 is a front view of the hair pack 100 according to the embodiment of the present invention.

First, referring to FIG. 1, in general, the hair pack 100 is configured for the user to wear on the head, and a pack agent for a hair pack is accommodated therein. In this case, a relatively larger space is provided in a portion corresponding to the back part of the user's head as compared with the forehead or both side parts of the user's head. Therefore, there is an advantage in that a user with long hair can easily use the hair pack while keeping the entire hair loose in the back part of the head.

Figure 2:
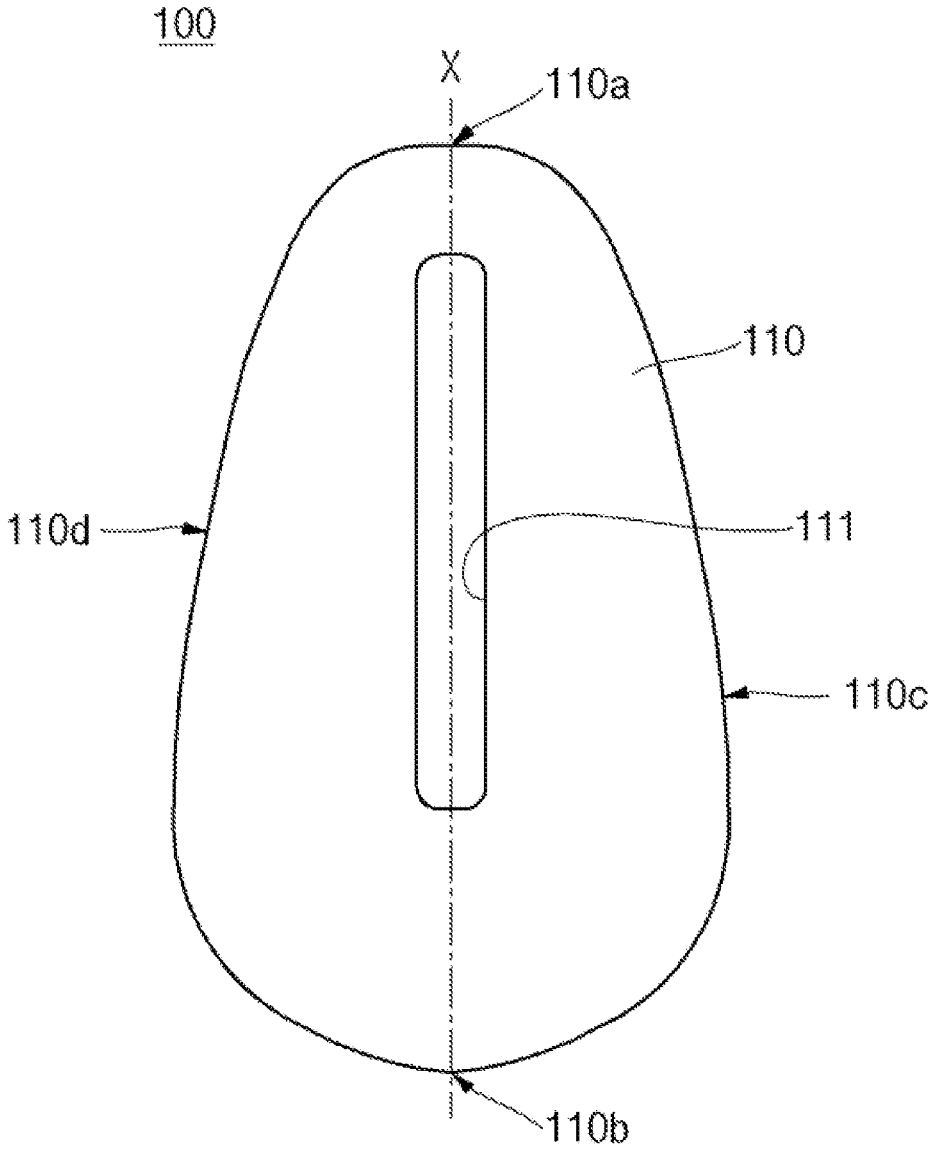
FIG. 2 is a bottom view of the hair pack according to the embodiment of the present invention.
Figure 3:
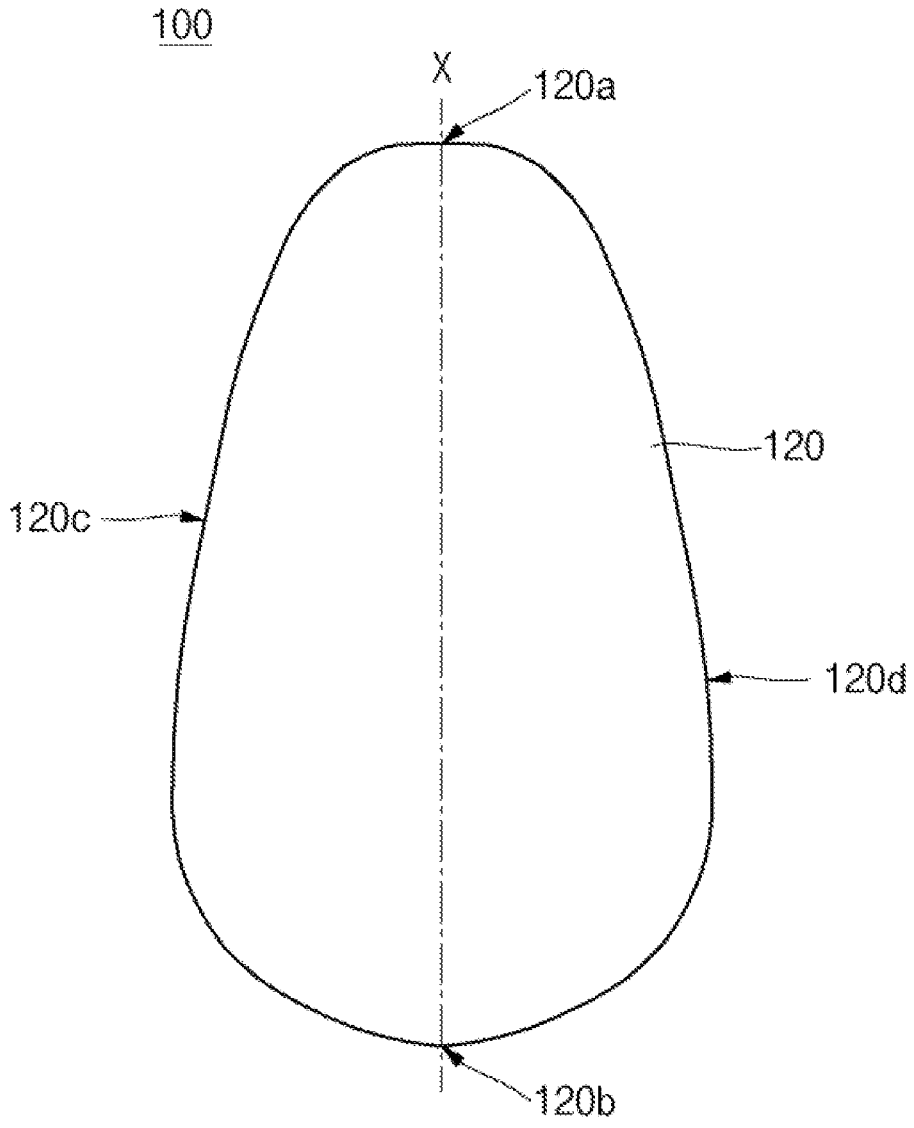
FIG. 3 is a plan view of the hair pack according to the embodiment of the present invention.
Figure 4:
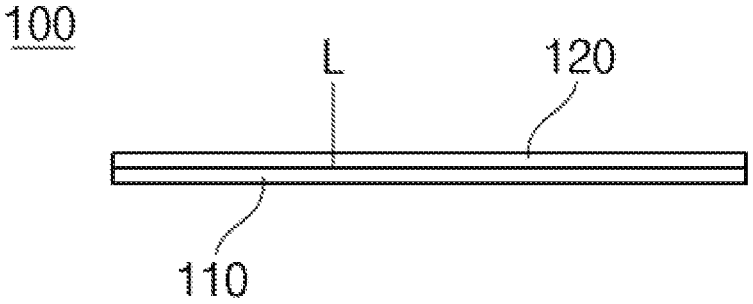
FIG. 4 is a front view of the hair pack according to the embodiment of the present invention.

More specifically, referring to FIGS. 2 to 4, the hair pack 100 includes a lower sheet 110 and an upper sheet 120. Herein, the terms "upper" and "lower" are merely used to distinguish between and refer to relative positions with respect to the use state of the hair pack 100, and are not intended to indicate absolute positions. Therefore, if the hair pack 100 is turned upside down, the lower sheet 110 will be seen as an upper sheet, and the upper sheet 120 will be seen as a lower sheet.

At least one of the lower sheet 110 and the upper sheet 120 may be manufactured using an elastic material.

The lower sheet 110 is formed in a round shape as a whole.

Particularly, the lower sheet 110 may be formed in a substantially elliptical shape as illustrated in FIG. 2. Herein, the term "elliptical shape" does not indicate only the trace of points whose sums of distances from two focal points are the same in a strict mathematical sense but is interpreted as encompassing any elongated round shapes in general.

In this case, the lower sheet 110 may be formed such that, along a long axis (X-axis) direction of the elliptical shape, the lower sheet 110 is gradually widened as a whole from one end side 110*a* to the other end side 110*b*. For instance, the lower sheet 110 may be formed in an oval shape similar to an egg shape as a whole.

Also, an opening 111 is formed in the lower sheet 110. As will be described below, the opening 111 is a portion in which the user puts his or her head when wearing the hair pack 100.

Accordingly, the circumference of the opening 111 may correspond to head circumferences of general users or formed to be slightly smaller than the same. If the lower sheet 110 is formed of an elastic material, and the circumference of the opening 111 is formed to be smaller than a head circumference of the user, the circumference of the opening 111 is extended to fit the head circumference of the user, and a surrounding portion of the opening 111 is adhered to the user's head. Therefore, it is possible to prevent the pack agent or other liquids from spilling through the opening 111 during use. Also, the user may walk around or participate in other activities without particular inconvenience even while wearing the hair pack 100. Furthermore, accordingly, since a separate means, such as a fastening strap or a tape, for fixing the hair pack 100 to fit the user's head circumference is not necessary, there are advantages in that the manufacturing cost is reduced, and the hair pack 100 is convenient to use.

The opening 111 may be formed in the shape of a narrow and long slit. Although the opening 111 is illustrated in FIG. 2 as being formed to extend longitudinally in the long axis (X-axis) direction, the opening 111 may also be formed to extend longitudinally in a direction parallel to a short axis direction of the elliptical shape. Accordingly, the surrounding portion of the opening 111 may fit and be adhered to the user's head well regardless of the shape of the user's head.

Particularly, the opening 111 may be formed on the long axis (X-axis) and eccentrically disposed toward the one end side 110*a* from the center of the elliptical shape.

The upper sheet 120 is a surface mostly covering the top part of the head and a surrounding portion thereof when the user is wearing the hair pack 100. As illustrated in FIG. 3, the upper sheet 120 is formed in a shape corresponding to the lower sheet 110. That is, the upper sheet 120 may also be formed in a substantially elliptical shape and formed such that, along the long axis (X-axis) direction of the elliptical shape, the upper sheet 120 is gradually widened as a whole from one end side 120*a* to the other end side 120*b*.

The lower sheet 110 and the upper sheet 120 are overlapped and sealed along the circumference thereof as illustrated in FIG. 4. That is, a sealing line L is formed to wrap around the one end sides 110*a* and 120*a*, portions 110*c* and 120*c* corresponding to the left side of the user's head, the other end sides 110*b* and 120*b*, portions 110*d* and 120*d* corresponding to the right side of the user's head, and the one side sides 110*a* and 120*a* again as a whole.

To this end, circumferences of the lower sheet 110 and the upper sheet 120 may be sealed with each other by sewing, or may be fixed to each other by heat sealing or using an adhesive. Of course, any other sealing methods known in the art may be employed to seal the circumferences of the lower sheet 110 and the upper sheet 120 with each other.

In this way, when the lower sheet 110 and the upper sheet 120 are sealed with each other along the circumferences thereof, a limited space is formed in a portion between the lower sheet 110 and the upper sheet 120 except for a portion in which the opening 111 is formed. In this case, the pack agent is accommodated in the space between the lower sheet 110 and the upper sheet 120.

As such, the pack agent may be injected after the lower sheet 110 and the upper sheet 120 are sealed with each other along the circumferences thereof, or the lower sheet 110 and the upper sheet 120 may be sealed with each other along the circumferences thereof while the pack agent is applied to or absorbed into surfaces of the lower sheet 110 and the upper sheet 120 facing each other, i.e., an upper surface of the lower sheet 110 and a lower surface of the upper sheet 120. Of course, any other known methods may be employed to accommodate the pack agent in a space between the lower sheet 110 and the upper sheet 120.

Referring back to FIG. 1, the user may put his or her head in the space between the lower sheet 110 and the upper sheet 120 through the opening 111 in order to wear the hair pack 100.

In this case, the one end sides 110*a* and 120*a* are oriented toward the forehead of the user, and the other end sides 110*b* and 120*b* are oriented toward the back part of the user's head.

As described above, the lower sheet 110 and the upper sheet 120 are formed in a substantially elliptical shape and formed to gradually widen toward the other end sides 110*b* and 120*b*, and the opening 111 is eccentrically disposed toward the one end side 110*a*. Accordingly, a relatively large space may be provided at the other end sides 110*b* and 120*b*, i.e., the back part of the user's head, with respect to the opening 111.

Therefore, a user with long hair may easily wear the hair pack 100 while keeping the hair loose in the back part of the head without piling the hair on top of his or her head.

Also, in this way, since it is possible to use the hair pack 100 while the entire hair is kept loose, the pack agent can be uniformly applied from the scalp to the tip of the hair, as compared with the case of using a hair pack while the hair is piled on top of the head.

Also, since the lower sheet 110 and the upper sheet 120 which mostly covers the top part of the user's head are overlapped and sealed along the circumference thereof, the sealing line L wraps around a surrounding portion of the top part of the user's head instead of being connected from the forehead to the back part of the head via the top part of the head.

Generally, a user wears the hair pack 100 by opening both sides of the opening 111, putting the head in the opening, and lowering the hair pack 100. If the sealing line L is connected from the forehead to the back part of the head via the top part of the head, stress may be concentrated on both ends of the sealing line L meeting the opening 111 when the user opens both sides of the opening 111, and thus the sealing line L corresponding to the both ends may be torn. Furthermore, when the user wears the hair pack 100 by lowering the hair pack 100 from the top of the head, since relatively large stress is applied to a portion of the sealing line L corresponding to the top part of the head, likewise, the sealing line L corresponding to the portion may be torn.

However, in the hair pack 100 according to the present invention, an opening 121 is formed in the lower sheet 110, and the sealing line L is formed to wrap around a surrounding portion of the opening 121 or a surrounding portion of the top part of the head. In this way, it is possible to prevent tearing of the sealing line L corresponding to the above-described portions.

Furthermore, according to the form in which the lower sheet 110 and the upper sheet 120, which are flat, are overlapped, the hair pack 100 is also formed to be flat as a whole. Therefore, since the hair pack 100 can be folded and packaged in a small size as necessary, and a plurality of hair packs 100 can be stacked together, there is an advantage in terms of space during distribution or storage.

Meanwhile, the lower sheet 110 and the upper sheet 120 may be manufactured using elastic non-woven fabric, and the space between the lower sheet 110 and the upper sheet 120 may be formed to correspond to the volume of the entire hair of a general user or formed to be slightly smaller than the volume.

Accordingly, since the lower sheet 110 and the upper sheet 120 may be adhered to the user's hair when the user is wearing the hair pack 100, the pack agent may be effectively absorbed into the hair even without the user performing a massage or the like on the hair.

In this case, a lower surface of the lower sheet 110 and an upper surface of the upper sheet 120 may be treated to be waterproof so that the pack agent does not seep therethrough.

Figure 5:
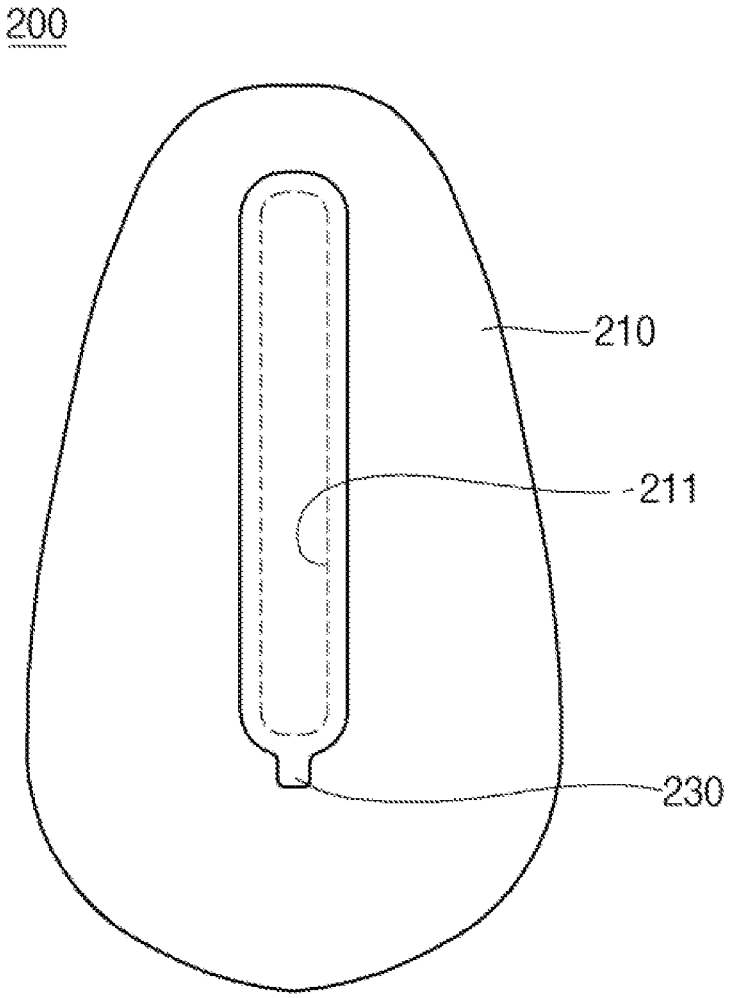
FIG. 5 is a bottom view of a hair pack according to another embodiment of the present invention.

FIG. 5 is a bottom view of a hair pack 200 according to another embodiment of the present invention.

As compared with the hair pack 100 according to the embodiment of the present invention described above with reference to FIGS. 2 to 4, the hair pack 200 according to another embodiment of the present invention differs in that the hair pack 200 further includes a sticker 230.

Other details of the hair pack 200 are substantially the same as those of the hair pack 100 according to the above-described embodiment of the present invention. Otherwise, even if there are some differences, the differences are merely those that are expected to be readily made by those of ordinary skill in the art by making modifications corresponding thereto. Therefore, duplicate description thereof will be omitted.

Referring to FIG. 5, the sticker 230 is detachably attached to a lower surface of a lower sheet 210 so that an opening 211 of the lower sheet 210 is blocked.

If the opening 211 is kept opened, a limited amount of a pack agent has to be applied only to a specific space between the lower sheet 210 and an upper sheet 120 so that the pack agent does not leak through the opening 211. However, when the opening 211 is blocked by the sticker 230, since there is no risk of the pack agent leaking to the outside through the opening 211, a sufficient amount of the pack agent may be applied to the entire space between the lower sheet 210 and the upper sheet 120. Also, in this way, the pack agent may be more evenly applied to the user's hair.

Furthermore, drying or denaturing of the pack agent due to the exposure of the pack agent to the outside through the opening 211 may also be prevented.

Of course, when the user uses the hair pack 200, the user will use it with the sticker 230 removed.

Figure 6:
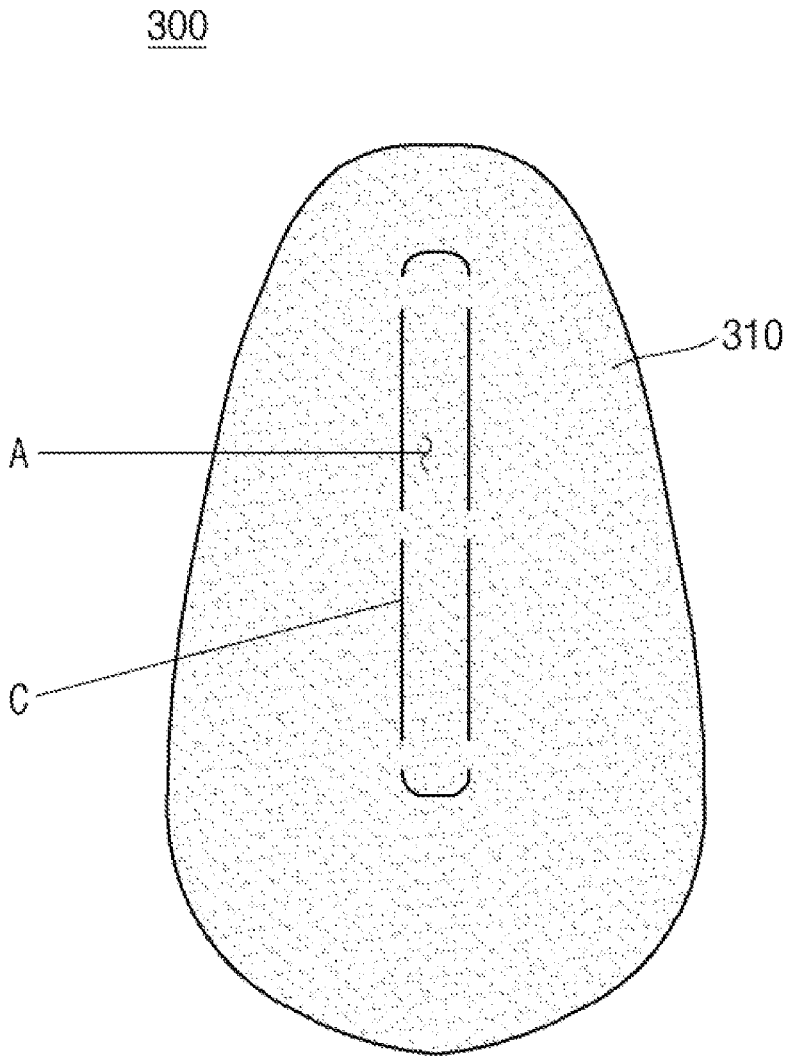
FIG. 6 is a bottom view illustrating a state before a sticker is attached to a hair pack according to still another embodiment of the present invention.
Figure 7:
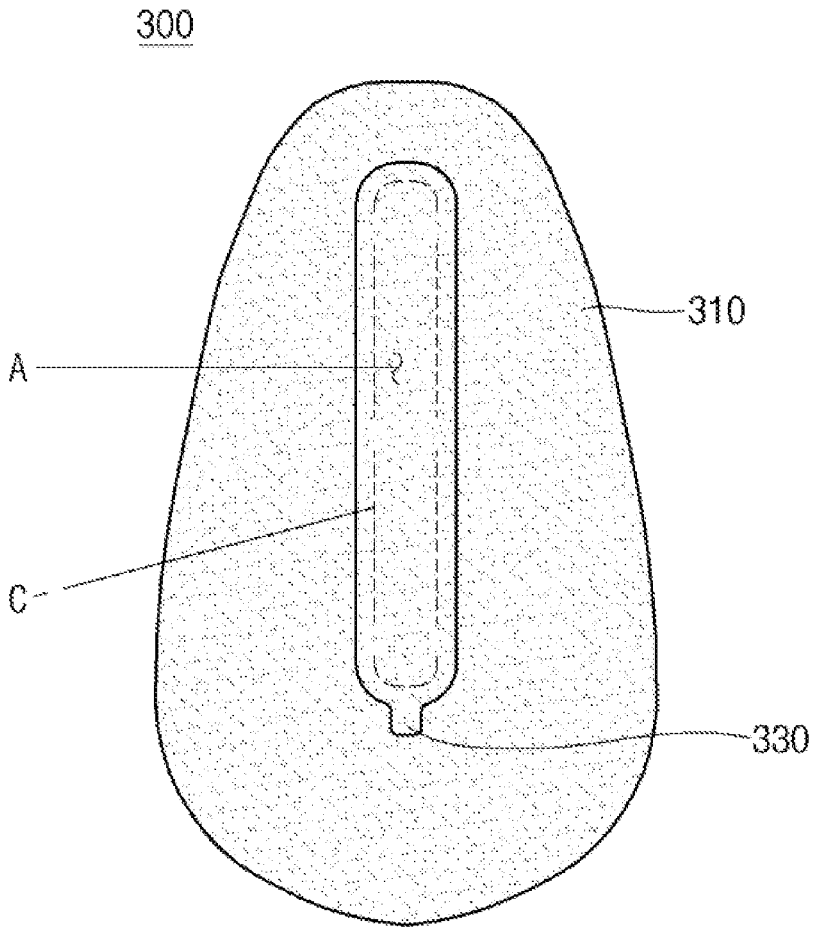
FIG. 7 is a bottom view illustrating a state in which the sticker is attached to the hair pack according to still another embodiment of the present invention.

FIG. 6 is a bottom view illustrating a state before a sticker 330 is attached to a hair pack 300 according to still another embodiment of the present invention. FIG. 7 is a bottom view illustrating a state in which the sticker 330 is attached to the hair pack 300 according to still another embodiment of the present invention. Further, FIG. 8 is a bottom view illustrating a state in which the sticker 330 is removed from the hair pack 300 according to still another embodiment of the present invention.

First, referring to FIG. 6, in a lower sheet 310, a cutting line C is formed along a circumference of an area A where an opening 311 is to be formed. In this case, the cutting line C is discontinuously formed. Therefore, in this state, the opening 311 is not completely formed yet.

Meanwhile, as illustrated in FIG. 7, the sticker 330 is formed larger than the area A and attached to the lower sheet 310 to cover the area A.

Figure 8:
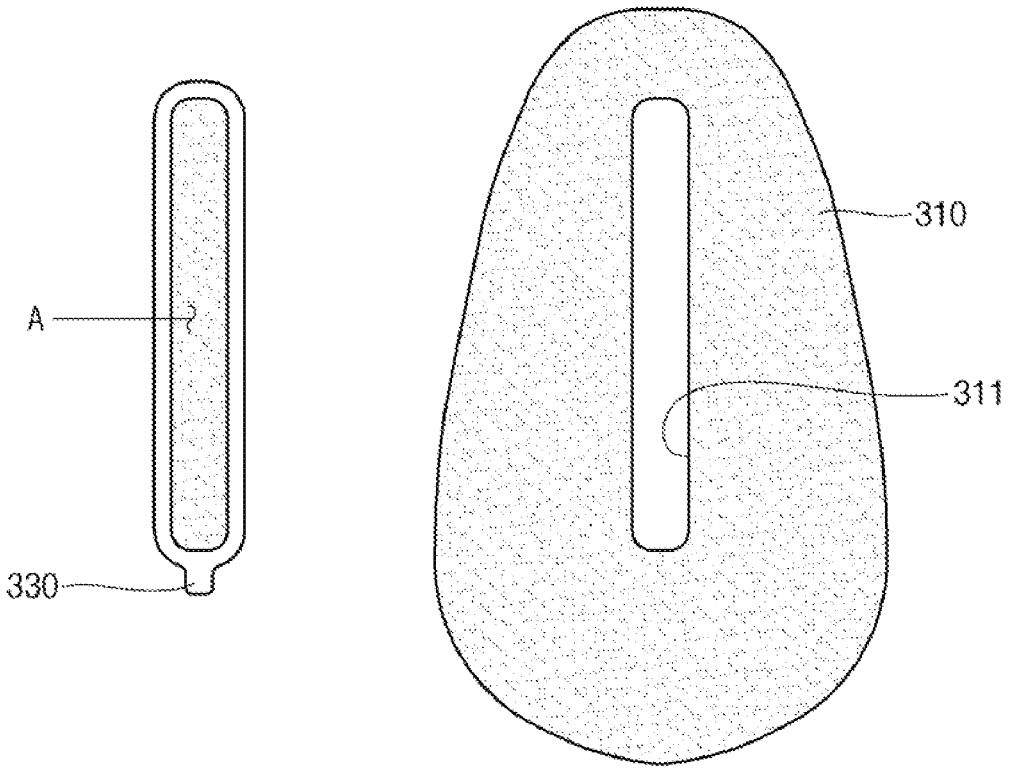
FIG. 8 is a bottom view illustrating a state in which the sticker is removed from the hair pack according to still another embodiment of the present invention.

In this case, when the user removes the sticker 330 to use the hair pack 300, as illustrated in FIG. 8, the area A is removed together with the sticker 330 and is torn apart and separated from the lower sheet 310. In this way, the opening 311 is completely formed in the lower sheet 310.

Accordingly, since the pack agent is prevented from coming into direct contact with the sticker 330 through the area A, the pack agent can be further prevented from being denatured.

Figure 9:
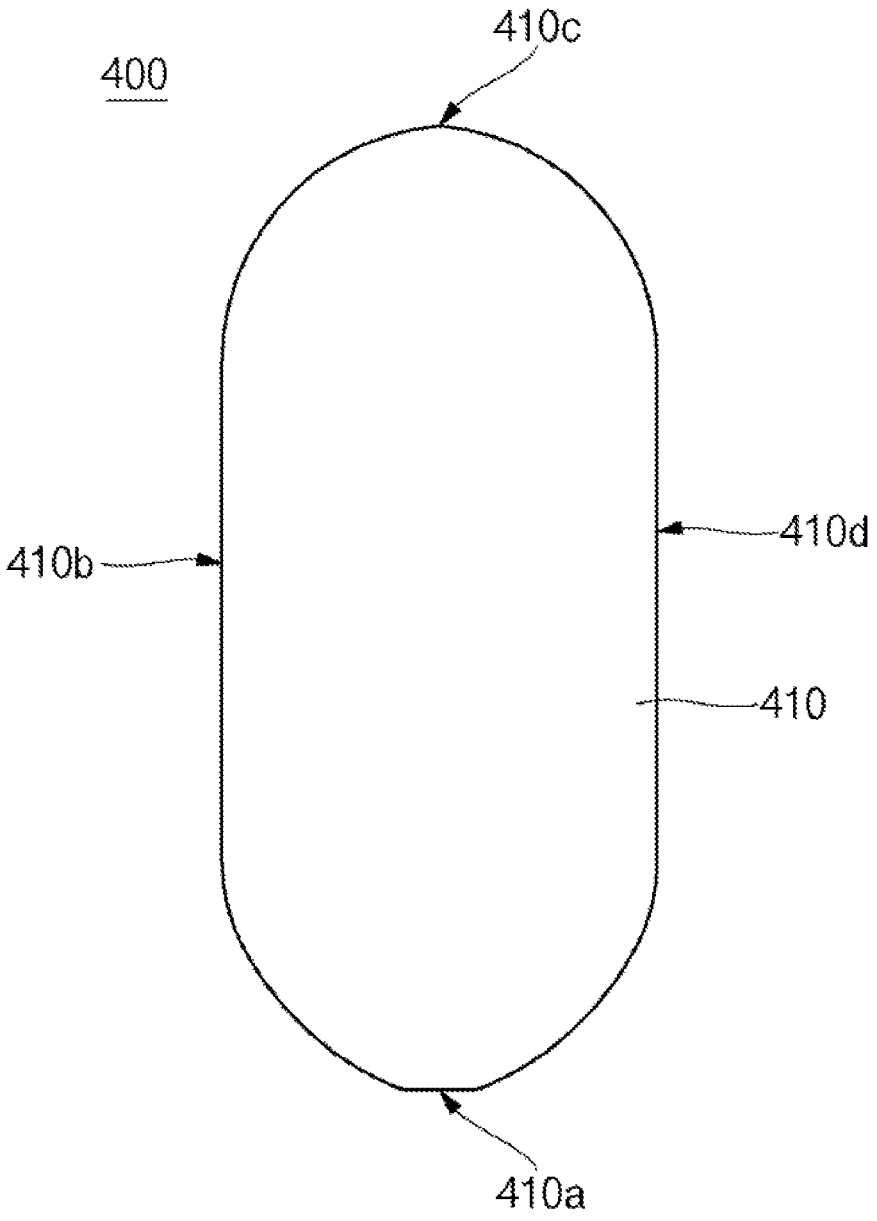
FIG. 9 is a bottom view of a foot pack according to another embodiment of the present invention.
Figure 10:
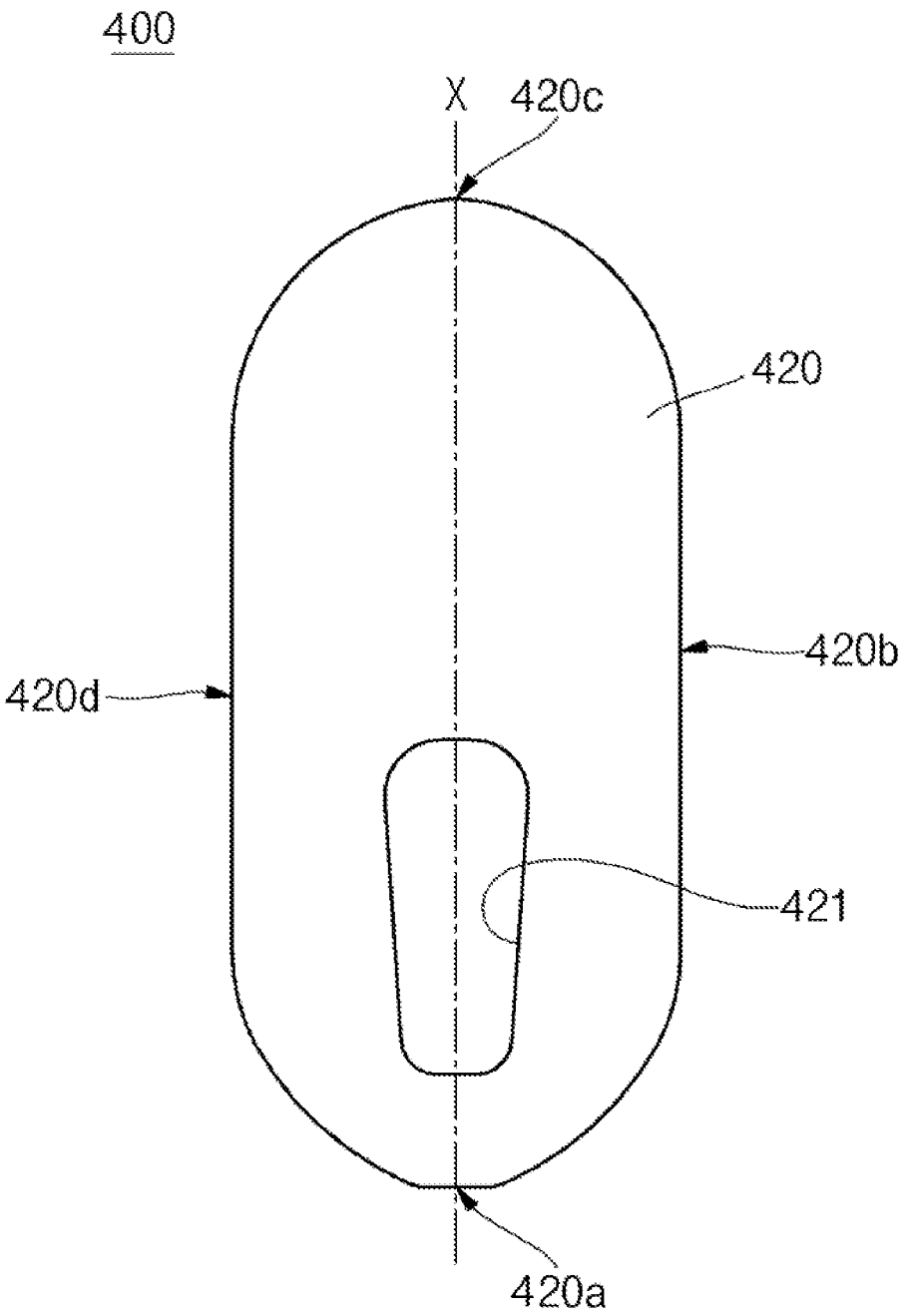
FIG. 10 is a plan view of the foot pack according to the embodiment of the present invention.

FIG. 9 is a bottom view of a foot pack according to another embodiment of the present invention. FIG. 10 is a plan view of the foot pack according to the embodiment of the present invention. Also, FIG. 11 is a front view of the foot pack according to the embodiment of the present invention.

Figure 11:
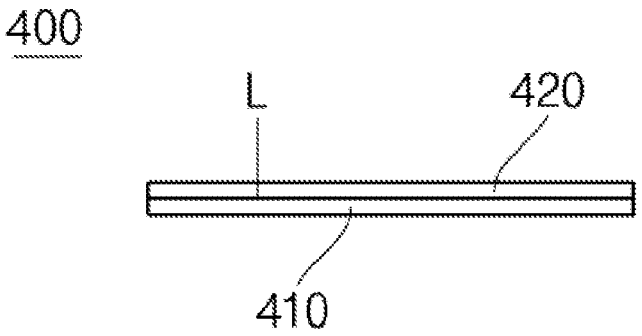
FIG. 11 is a front view of the foot pack according to the embodiment of the present invention.

Referring to FIGS. 9 to 11, the foot pack 400 includes a lower sheet 410 and an upper sheet 420. Herein, the terms "upper" and "lower" are merely used to distinguish between and refer to relative positions with respect to the use state of the hair pack 400, and are not intended to indicate absolute positions. Therefore, if the hair pack 400 is turned upside down, the lower sheet 410 will be seen as an upper sheet, and the upper sheet 420 will be seen as a lower sheet.

The lower sheet 410 has a shape substantially corresponding to a bottom of a foot, so that the lower sheet 410 mainly covers the bottom of the foot when a user puts on the foot pack 400. However, the shape of the lower sheet 410 may not exactly correspond to the shape of the bottom of the foot. In some embodiments, the lower sheet 410 may have an elliptical shape or an elongated round shape as a whole, as illustrated in FIG. 9.

The lower sheet 410 may be manufactured using an elastic material.

The upper sheet 420 has a shape corresponding to the shape of the lower sheet 410, as illustrated in FIG. 10, so that the upper sheet 420 mainly covers a top side of the foot when the user puts on the foot pack 400.

Also, an opening 421 is formed in the upper sheet 420. As will be described below, the opening 421 is a portion in which the user puts his or her foot when wearing the foot pack 400. Accordingly, the circumference of the opening 421 may correspond to ankle circumferences of general users or formed to be slightly smaller than the same.

In particular, the upper sheet 420 is formed of an elastic material, and the circumference of the opening 421 is formed to be smaller than an ankle circumference of the user. In this configuration, the circumference of the opening 421 is extended to fit the ankle circumference of the user, and a surrounding portion of the opening 421 is adhered to the user's ankle. Therefore, it is possible to prevent the foot pack 400 from splitting off from the foot of the user during use. Further, accordingly, since a separate means, such as a fastening strap or a tape, for fixing the foot pack 400 to fit the user's ankle circumference is not necessary, there are advantages in that the manufacturing cost is reduced, and the foot pack 400 is convenient to use.

To generally fit to the ankle of the user, as illustrated in FIG. 10, the opening 421 may be formed in an elliptical shape elongated on the long axis (X-axis). In particular, the opening 421 may be eccentrically disposed toward a portion 420*a* corresponding to a heel of the foot from the center of the upper sheet 420, so that the opening 421 is well fitted to the ankle of the user.

The lower sheet 410 and the upper sheet 420 are overlapped and sealed along the circumference thereof as illustrated in FIG. 11. That is, a sealing line L is formed to wrap around portions 410*a* and 420*a* corresponding to the heel of the foot, portions 410*b* and 420*b* corresponding to an inner side of the foot, portions 410*c* and 420*c* corresponding to the toes of the foot, portions 410*d* and 420*d* corresponding to an outside of the foot, and the portions 410*a* and 420*a* corresponding to the heel of the foot again as a whole.

To this end, circumferences of the lower sheet 410 and the upper sheet 420 may be sealed with each other by sewing, or may be fixed to each other by heat sealing or using an adhesive. Of course, any other sealing methods known in the art may be employed to seal the circumferences of the lower sheet 410 and the upper sheet 420 with each other.

In this way, when the lower sheet 410 and the upper sheet 420 are sealed with each other along the circumferences thereof, a limited space is formed in a portion between the lower sheet 410 and the upper sheet 420 except for a portion in which the opening 421 is formed. In this case, the pack agent is accommodated in the space between the lower sheet 410 and the upper sheet 420.

As such, the pack agent may be injected after the lower sheet 410 and the upper sheet 420 are sealed with each other along the circumferences thereof, or the lower sheet 410 and the upper sheet 420 may be sealed with each other along the circumferences thereof while the pack agent is applied to or absorbed into surfaces of the lower sheet 410 and the upper sheet 420 facing each other, i.e., an upper surface of the lower sheet 410 and a lower surface of the upper sheet 420. Of course, any other known methods may be employed to accommodate the pack agent in a space between the lower sheet 410 and the upper sheet 420.

Figure 12:
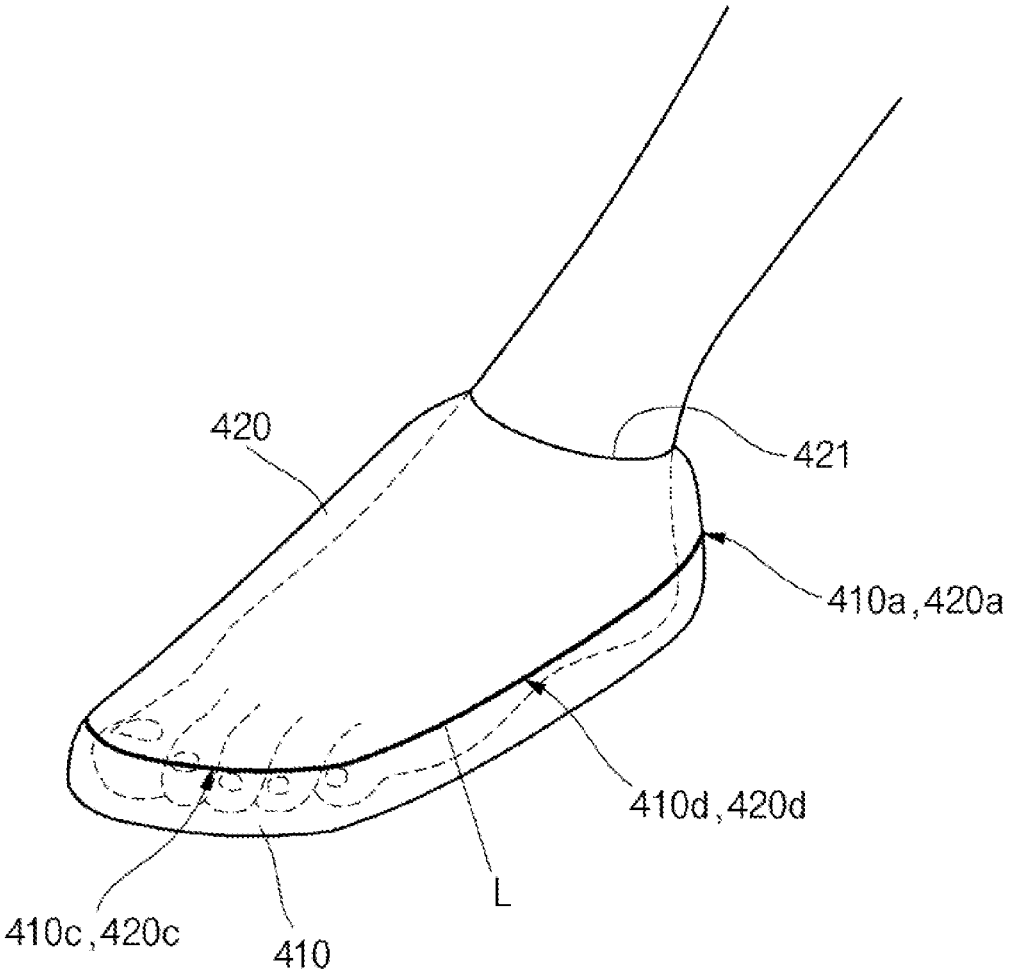
FIG. 12 is a perspective view illustrating a state in which a user is putting on a foot pack according to an embodiment of the present invention.

FIG. 12 is a perspective view illustrating a state in which a user is putting on a foot pack according to an embodiment of the present invention.

Referring to FIG. 12, the user may put his or her foot in the space between the lower sheet 410 and the upper sheet 420 through the opening 421 in order to put on the foot pack 400.

If the sealing line L were connected from the opening 421 to the heel part of the foot via the top and toe parts of the foot, stress may be concentrated on both ends of the sealing line L meeting the opening 421 when the user opens both sides of the opening 421, and thus the sealing line L corresponding to the both ends may be torn. Furthermore, when the user walks with the foot pack put on the foot, a portion of the sealing line in the bottom part of the foot pack may be torn due to friction between the foot pack and the ground. In this case, the pack agent may be leaked from the torn portion and the user may slip over the slipper surface of the ground where the pack agent spreads.

However, in the hair pack 400 according to the present invention, an opening 421 is formed in the upper sheet 410, and the sealing line L is formed to wrap around a surrounding portion of the opening 421 or a surrounding portion of the foot. In this way, it is possible to prevent tearing of the sealing line L corresponding to the above-described portions.

Further, when the user stands with the foot pack 400 put on the foot, the sealing line L is located horizontally above the ground, the pack agent may be prevented from being leaked out of the foot pack 400 even when a portion of the sealing line L is torn.

Furthermore, according to the form in which the lower sheet 410 and the upper sheet 420, which are flat, are overlapped, the foot pack 400 is also formed to be flat as a whole. Therefore, since the foot pack 400 can be folded and packaged in a small size as necessary, and a plurality of foot packs 400 can be stacked together, there is an advantage in terms of space during distribution or storage.

Meanwhile, the lower sheet 410 and the upper sheet 420 may be manufactured using elastic non-woven fabric, and the space between the lower sheet 410 and the upper sheet 420 may be formed to correspond to the volume of the entire foot of a general user or formed to be slightly smaller than the volume.

Accordingly, since the lower sheet 410 and the upper sheet 420 may be adhered to the user's foot when the user is putting on the foot pack 400, the pack agent may be effectively absorbed into the foot.

In this case, a lower surface of the lower sheet 410 and an upper surface of the upper sheet 420 may be treated to be waterproof so that the pack agent does not seep therethrough.

Figure 13:
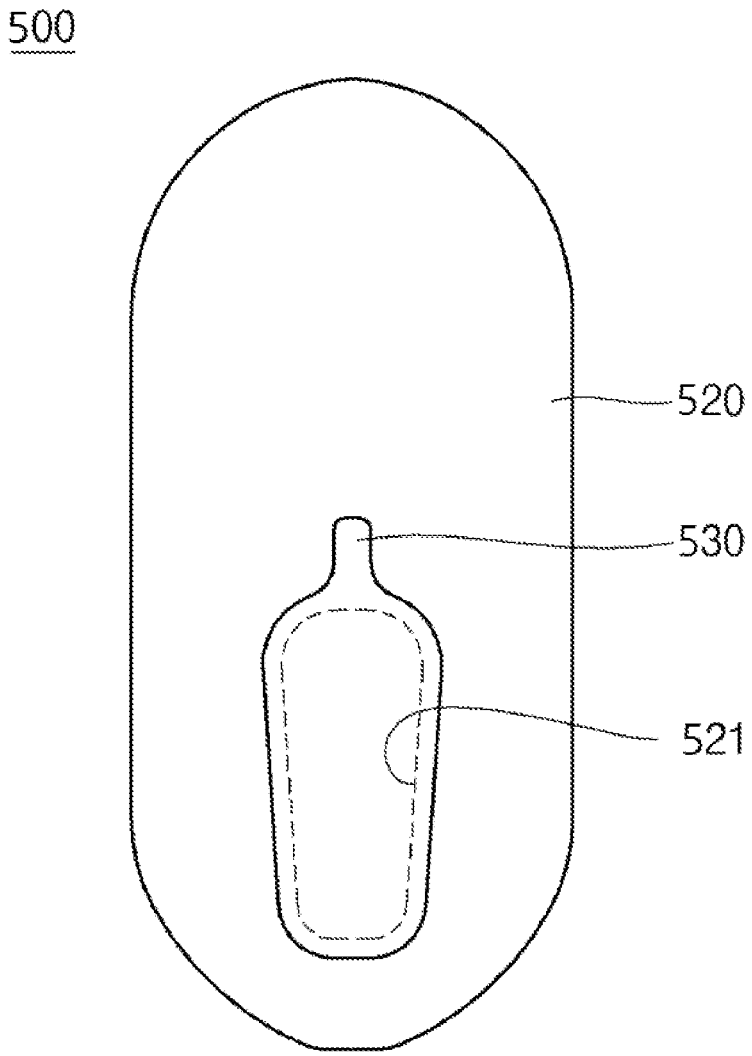
FIG. 13 is a plan view of a foot pack according to another embodiment of the present invention.

FIG. 13 is a plan view of a foot pack according to another embodiment of the present invention.

As compared with the foot pack 400 according to the embodiment of the present invention described above with reference to FIGS. 9 to 11, the foot pack 500 according to another embodiment of the present invention differs in that the foot pack 500 further includes a sticker 530.

Other details of the foot pack 500 are substantially the same as those of the foot pack 400 according to the above-described embodiment of the present invention. Otherwise, even if there are some differences, the differences are merely those that are expected to be readily made by those of ordinary skill in the art by making modifications corresponding thereto. Therefore, duplicate description thereof will be omitted.

Referring to FIG. 13, the sticker 530 is detachably attached to an upper surface of an upper sheet 520 so that an opening 521 of the upper sheet 520 is blocked.

If the opening 521 is kept opened, a limited amount of a pack agent has to be applied only to a specific space between the lower sheet 510 and an upper sheet 520 so that the pack agent does not leak through the opening 521. However, when the opening 521 is blocked by the sticker 530, since there is no risk of the pack agent leaking to the outside through the opening 521, a sufficient amount of the pack agent may be applied to the entire space between the lower sheet 510 and the upper sheet 520. Also, in this way, the pack agent may be more evenly applied to the user's foot.

Furthermore, drying or denaturing of the pack agent due to the exposure of the pack agent to the outside through the opening 521 may also be prevented.

Of course, when the user uses the foot pack 500, the user will use it with the sticker 530 removed.

Figure 14:
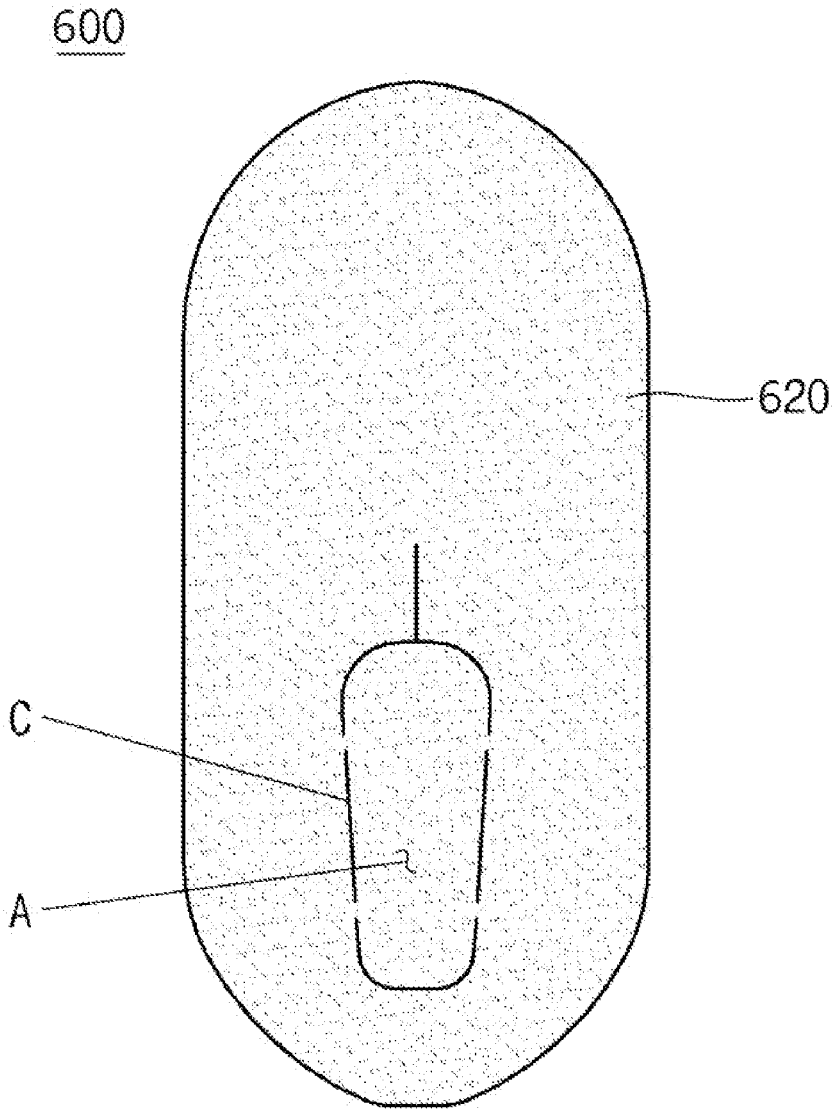
FIG. 14 is a plan view illustrating a state before a sticker is attached to a foot pack according to still another embodiment of the present invention.
Figure 15:
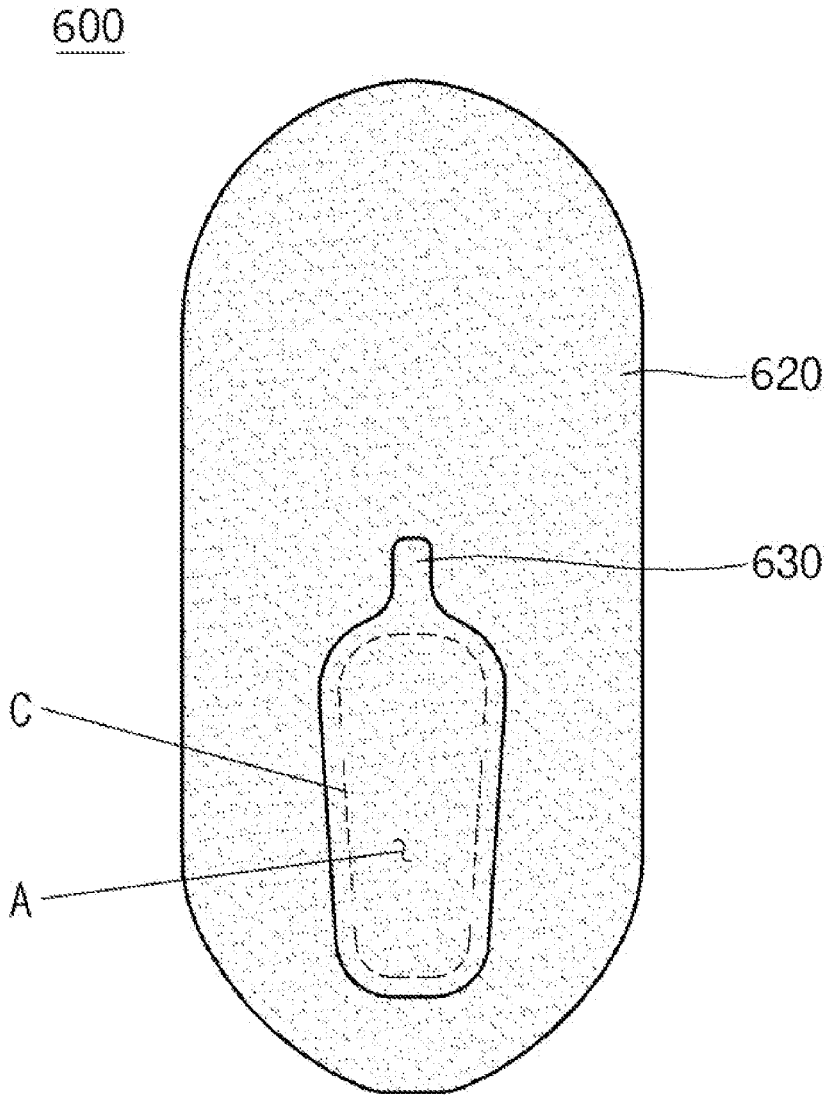
FIG. 15 is a plan view illustrating a state in which the sticker is attached to the foot pack according to still another embodiment of the present invention.
Figure 16:
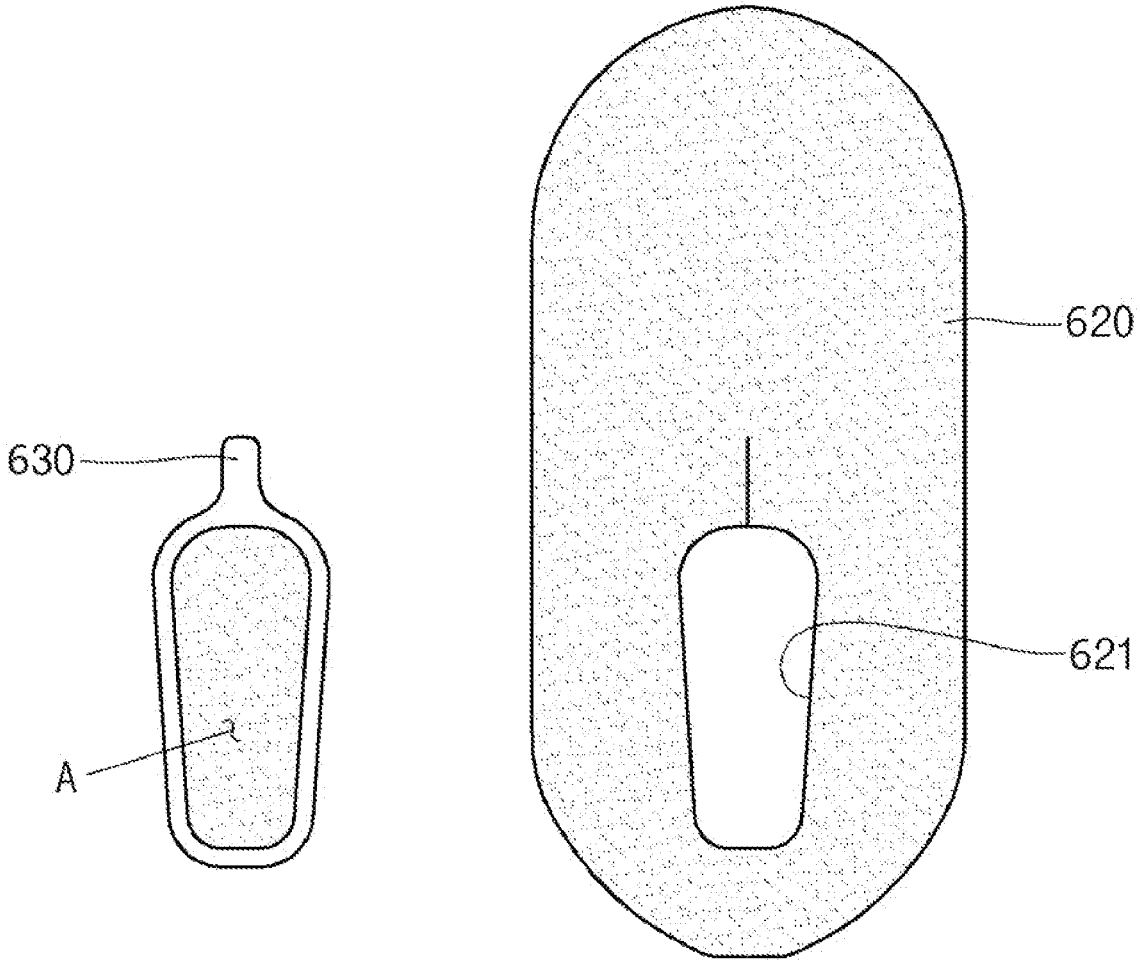
FIG. 16 is a plan view illustrating a state in which the sticker is removed from the foot pack according to still another embodiment of the present invention.

FIG. 14 is a plan view illustrating a state before a sticker is attached to a foot pack according to still another embodiment of the present invention. FIG. 15 is a plan view illustrating a state in which the sticker is attached to the foot pack according to still another embodiment of the present invention. FIG. 16 is a plan view illustrating a state in which the sticker is removed from the foot pack according to still another embodiment of the present invention.

First, referring to FIG. 14, in an upper sheet 620, a cutting line C is formed along a circumference of an area A where an opening 621 is to be formed. In this case, the cutting line C is discontinuously formed. Therefore, in this state, the opening 621 is not completely formed yet.

Meanwhile, as illustrated in FIG. 15, the sticker 630 is formed larger than the area A and attached to the upper sheet 620 to cover the area A.

In this case, when the user removes the sticker 630 to use the foot pack 600, as illustrated in FIG. 16, the area A is removed together with the sticker 630 and is torn apart and separated from the upper sheet 620. In this way, the opening 621 is completely formed in the upper sheet 620.

Accordingly, since the pack agent is prevented from coming into direct contact with the sticker 630 through the area A, the pack agent can be further prevented from being denatured.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A wearable pack comprising:

a first sheet having an elliptical shape;

a second sheet coupled to the first sheet, wherein the second sheet has a shape corresponding to the first sheet and comprises an opening that is sealable, wherein an inner space is formed between the first sheet and the second sheet, and configured to accommodate a pack agent, wherein when the wearable pack is worn by a user, a first part of the inner space is configured to be positioned adjacent to a forehead of the user, a second part of the inner space is configured to be positioned adjacent to a back of a head of the user, and the second part is configured to be bigger than the first part, wherein the opening in the second sheet has a slit shape positioned in a center portion of the second sheet, and extending in a long axis direction of the elliptical shape, and wherein a circumference of the first sheet is sealed to a circumference of the second sheet by using at least one of sewing, heat sealing or an adhesive; and a sticker configured to be detachably attached to the second sheet, wherein the sticker is configured to block the opening before the sticker is detached by the user, and configured to be detached from the second sheet by the user, wherein the opening comprises an inner area of the second sheet, and the inner area is configured to be enclosed by a discontinuous cutting line positioned along a circumference of the opening and attached to the sticker, wherein when the sticker is detached from the second sheet, the inner area is configured to be removed from the second sheet, together with the sticker, wherein the pack agent is configured to be accommodated in the inner space in the state of being applied to or absorbed into a surface of at least one of the first sheet or the second sheet, and wherein the first sheet and the second sheet are treated to be waterproof.

2. The wearable pack according to claim 1, wherein the first sheet includes a first end portion configured to cover the first part of the inner space, and a second end portion configured to cover the second part of the inner space, the second end portion is wider than the first end portion, and a width of the first sheet is gradually widened in a direction from the first end portion to the second end portion, and wherein the opening of the second sheet is positioned closer to the first end portion than the second end portion.

3. The wearable pack of claim 1, wherein:

at least a partial region including a surrounding portion of the opening in the second sheet is made of an elastic material.

4. The wearable pack of claim 1, wherein a longitudinal axis of the slit shape of the opening is identical to a longitudinal axis of the elliptical shape of the second sheet, and wherein the slit shape of the opening is symmetrical with respect to the longitudinal axis of the slit shape of the opening, and the elliptical shape of the second sheet is symmetrical with respect to the longitudinal axis of the elliptical shape of the second sheet.

5. The wearable pack of claim 1, wherein the sticker is larger than the inner area, a shape of the sticker corresponds to a shape of the inner area, and the sticker covers the entire portion of the inner area.

6. The wearable pack of claim 1, wherein the pack agent is prevented from coming into direct contact with the sticker through the inner area, which is configured to separate the pack agent from the sticker.

7. A wearable pack comprising:

a first sheet having an oval shape;

a second sheet coupled to the first sheet, wherein the second sheet has a shape corresponding to the first sheet and comprises an opening that is sealable, wherein an inner space is formed between the first sheet and the second sheet, and configured to accommodate a pack agent wherein when the wearable pack is worn by a user, a first part of the inner space is configured to be positioned adjacent to a forehead of the user, a second part of the inner space is configured to be positioned adjacent to a back of a head of the user, and the second part is configured to be bigger than the first part, wherein the opening in the second sheet has a slit shape positioned in a center portion of the second sheet, and extending in a long axis direction of the oval shape, and wherein a circumference of the first sheet is sealed to a circumference of the second sheet by using at least one of sewing, heat sealing or an adhesive; and a sticker configured to be detachably attached to the second sheet, wherein the sticker is configured to block the opening before the sticker is detached by the user, and configured to be detached from the second sheet by the user, wherein the opening comprises an inner area of the second sheet, and the inner area is configured to be enclosed by a discontinuous cutting line positioned along a circumference of the opening, wherein when the sticker is detached from the second sheet, the inner area is configured to be removed from the second sheet together with the sticker, wherein the pack agent is configured to be accommodated in the inner space in the state of being applied to or absorbed into a surface of at least one of the first sheet or the second sheet, and wherein the first sheet and the second sheet are treated to be waterproof.

8. The wearable pack of claim 7, wherein:

at least a partial region including a surrounding portion of the opening in the second sheet is made of an elastic material.

9. The wearable pack of claim 7, wherein at least one of the first sheet and the second sheet is made of elastic material.

10. The wearable pack of claim 7, wherein a longitudinal axis of the slit shape of the opening is identical to a longitudinal axis of the oval shape of the second sheet, and wherein the slit shape of the opening is symmetrical with respect to the longitudinal axis of the slit shape of the opening, and the oval shape of the second sheet is symmetrical with respect to the longitudinal axis of the oval shape of the second sheet.

11. The wearable pack of claim 7, wherein the sticker is larger than the inner area, a shape of the sticker corresponds to a shape of the inner area, and the sticker covers the entire portion of the inner area.

12. The wearable pack of claim 7, wherein the pack agent is prevented from coming into direct contact with the sticker through the inner area, which is configured to separate the pack agent from the sticker.

* * * * *